US005323698A

United States Patent [19]

Prevost

[11] Patent Number: 5,323,698

[45] Date of Patent: Jun. 28, 1994

[54] PRESS FOR COMPRESSING DRUMS OF CONTAMINATED WASTE

[75] Inventor: Jacques Prevost, Coueron, France

[73] Assignee: ACB, Paris, France

[21] Appl. No.: 12,437

[22] Filed: Feb. 2, 1993

[30] Foreign Application Priority Data

Feb. 3, 1992 [FR] France ..... 92 01163

[51] Int. Cl.[5] ..... B30B 1/32

[52] U.S. Cl. ..... 100/246; 100/269 R; 100/902

[58] Field of Search ..... 100/246–248, 100/252, 253, 269 R, 902; 252/626, 633; 376/260

[56] References Cited

U.S. PATENT DOCUMENTS

| | | | |
|---|---|---|---|
| 2,327,117 | 8/1943 | Lorant | 100/252 X |
| 4,610,199 | 9/1986 | Pols | 100/269 R |
| 4,685,391 | 8/1987 | Picker | 100/246 X |

FOREIGN PATENT DOCUMENTS

| | | | |
|---|---|---|---|
| 0124185 | 11/1984 | European Pat. Off. | 100/902 |
| 0125552 | 11/1984 | European Pat. Off. . | |
| 57-156896 | 9/1982 | Japan | 100/269 R |
| 1-133700 | 5/1989 | Japan | 100/902 |

*Primary Examiner*—Stephen F. Gerrity
*Attorney, Agent, or Firm*—Sughrue, Mion, Zinn, Macpeak & Seas

[57] ABSTRACT

A press for compressing drums of contaminated waste. The press comprises a frame made up of a table and a crosshead connected to the table by means of vertical supports, and a compression assembly including a main cylinder secured to the crosshead. A main piston is situated inside the main cylinder and delimits a main chamber between the piston and the cylinder head of the main cylinder. The main piston is extended by a depending ram rod. A skirt is designed to surround the drum when it is being compressed by the ram. The skirt is extended at its top by a tubular piston slidably received in the main cylinder between the main cylinder and the ram rod. An intermediate chamber is delimited between the tubular piston and the main piston. An annular chamber is delimited between the tubular piston and the bottom of the main cylinder. The main chamber and the annular chamber have ducts fed with a control fluid, and the intermediate chamber has a sealed sliding device for enabling the intermediate chamber to be fed with the control fluid.

6 Claims, 6 Drawing Sheets

PRESS FOR COMPRESSING DRUMS OF CONTAMINATED WASTE

The present invention relates to a press for compressing drums of contaminated waste.

BACKGROUND OF THE INVENTION

For example, Document EP-A-0124185 discloses a press comprising a table provided with four pillars supporting a crosshead at their top ends, which crosshead forms the main cylinder for a ram piston and supports two control actuators for raising and lowering a skirt that is lowered to cover the drum to be compressed when said drum is deposited on a pressing block situated on the table. During compression, the ram penetrates into the skirt which thus protects the drum. Once the drum has been compressed, the ram piston is raised again, as is the skirt which is retracted up inside the cylinder of the ram piston while surrounding the ram. The ram piston is in turn provided with a non-through bore which acts as a cylinder for a fixed piston secured to the top end of the main cylinder. This makes it possible to exert "low thrust" during a first stage of the press stroke by feeding the chamber situated beneath the fixed piston and whose cross-sectional area is small, and to exert higher thrust during a second stage of the press stroke by feeding the chamber situated above the ram piston and whose cross-sectional area corresponds to the entire cross-sectional area of the main cylinder.

Such a press therefore includes two actuators for the skirt, in addition to the ram piston which cooperates with the fixed piston to form a compound actuator.

OBJECT AND SUMMARY OF THE INVENTION

An object of the invention is to provide a simpler press including a sole compound actuator while performing the s&ne functions.

The invention therefore provides a press for compressing drums of contaminated waste, said press comprising a frame made up of a table and a crosshead connected to the table by means of vertical supports, and a compression assembly including a main cylinder secured to the crosshead, a main piston situated inside said main cylinder and delimiting a main chamber between said piston and the cylinder head of said main cylinder, said main piston being extended by a ram rod, and a skirt designed to surround said drum when it is being compressed by the ram, wherein said skirt is extended at its top by a tubular piston received in said main cylinder between said main cylinder and said ram rod, with an intermediate chamber being delimited between said tubular piston and the main piston, and an annular chamber being delimited between said tubular piston and the bottom end of the main cylinder, said main chamber and said annular chamber having ducts via which they can be fed with control fluid, and wherein said intermediate chamber has a sealed sliding device enabling said intermediate chamber to be fed with control fluid.

BRIEF DESCRIPTION OF THE DRAWINGS

An embodiment of the invention is described by way of example with reference to the accompanying drawings, in which.

DETAILED DESCRIPTION

Figure 1:
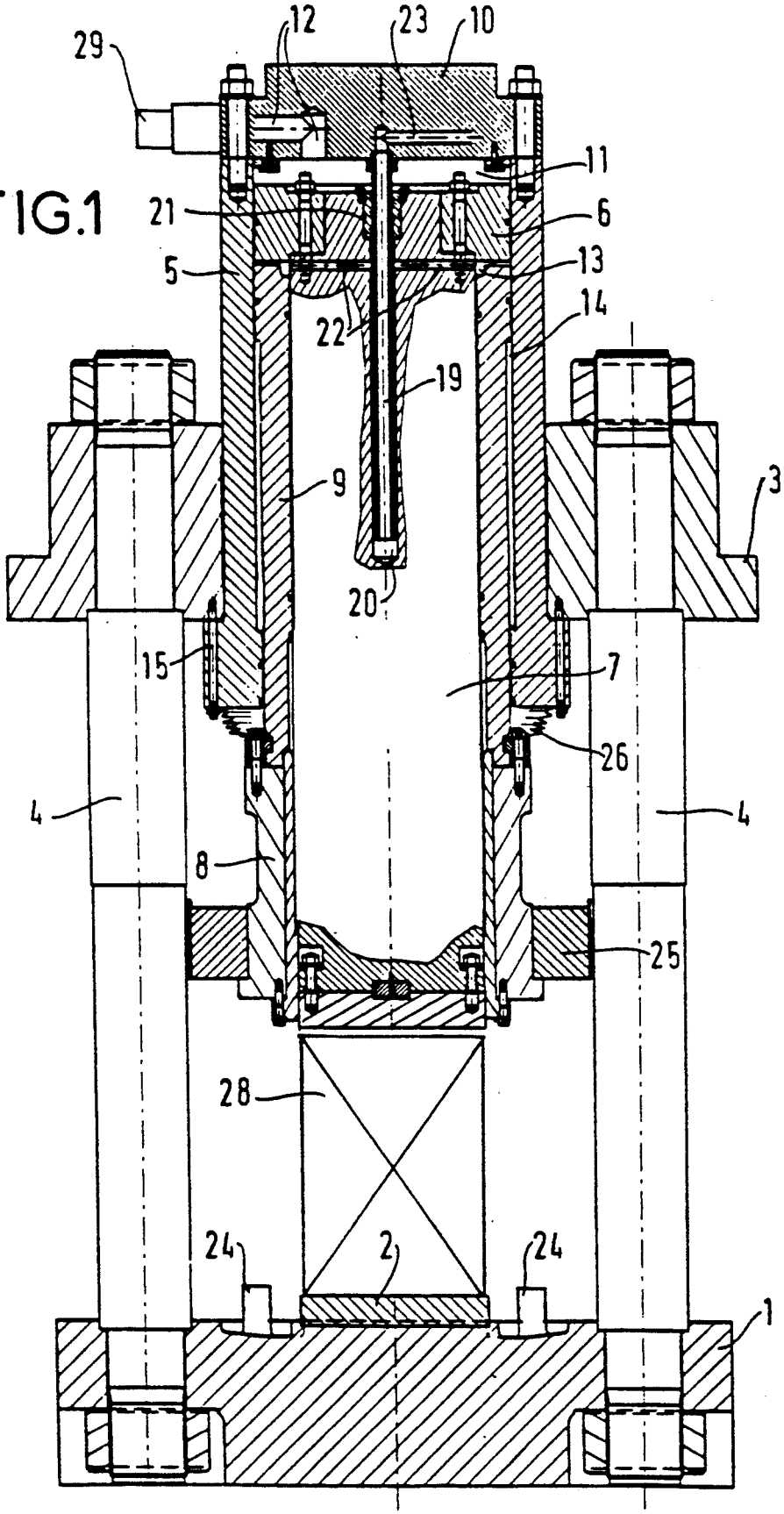
FIG. 1 shows a press of the invention in axial section and in the initial position at the beginning of a compression cycle. In this view, and in the following three views, the section is taken on A—A shown in FIG. 6.

With reference to FIG. 1, the press includes a frame made up of a table 1 with a pressing block 2 at its center, and a crosshead 3 connected to the table 1 via four vertical pillars 4. The press further includes a compression assembly comprising a main cylinder 5, a main piston 6 extended by a ram rod 7, and a skirt 8, the top end of which is secured to a tubular piston 9.

The main cylinder 5 is closed at its top end by a cylinder head 10 and is open at its bottom end. The main cylinder 5 contains the main piston 6. The main piston 6 cooperates with the cylinder head 10 of the main cylinder to delimit a main chamber 11 therebetween. The main chamber may be fed with control fluid via ducts 12 provided in the cylinder head 10.

The tubular piston 9 secured to the skirt 8 slides inside the main cylinder 5, between the main cylinder and the ram rod 7. An intermediate chamber 13 is delimited between the tubular piston 9 and the main piston 6, and an annular chamber 14 is delimited between the tubular piston and the bottom end of the main cylinder 5.

Figure 4:
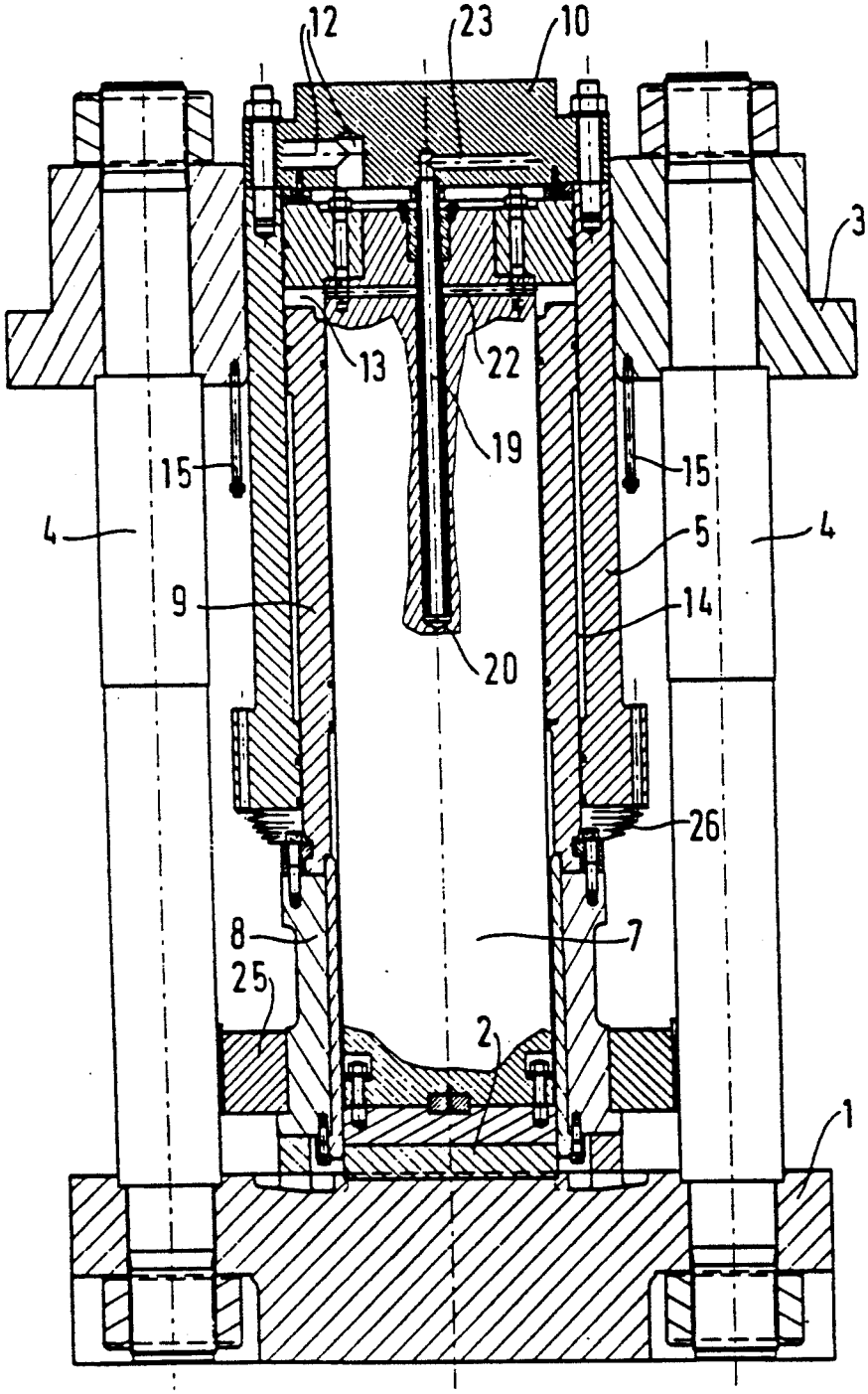
FIG. 4 shows the press in the transport position, in which its overall height is reduced.

The main cylinder 5 is removably fixed to the crosshead 3 by means of bolts 15. By unscrewing the bolts 15, it is thus possible to lower the main cylinder 5, once the piston 6 with its ram 7 and the skirt 8 with its tubular piston 9 have been placed in the low position, thereby reducing the overall height of the press and facilitating transport thereof. FIG. 4 shows the press in this position.

Figure 6:
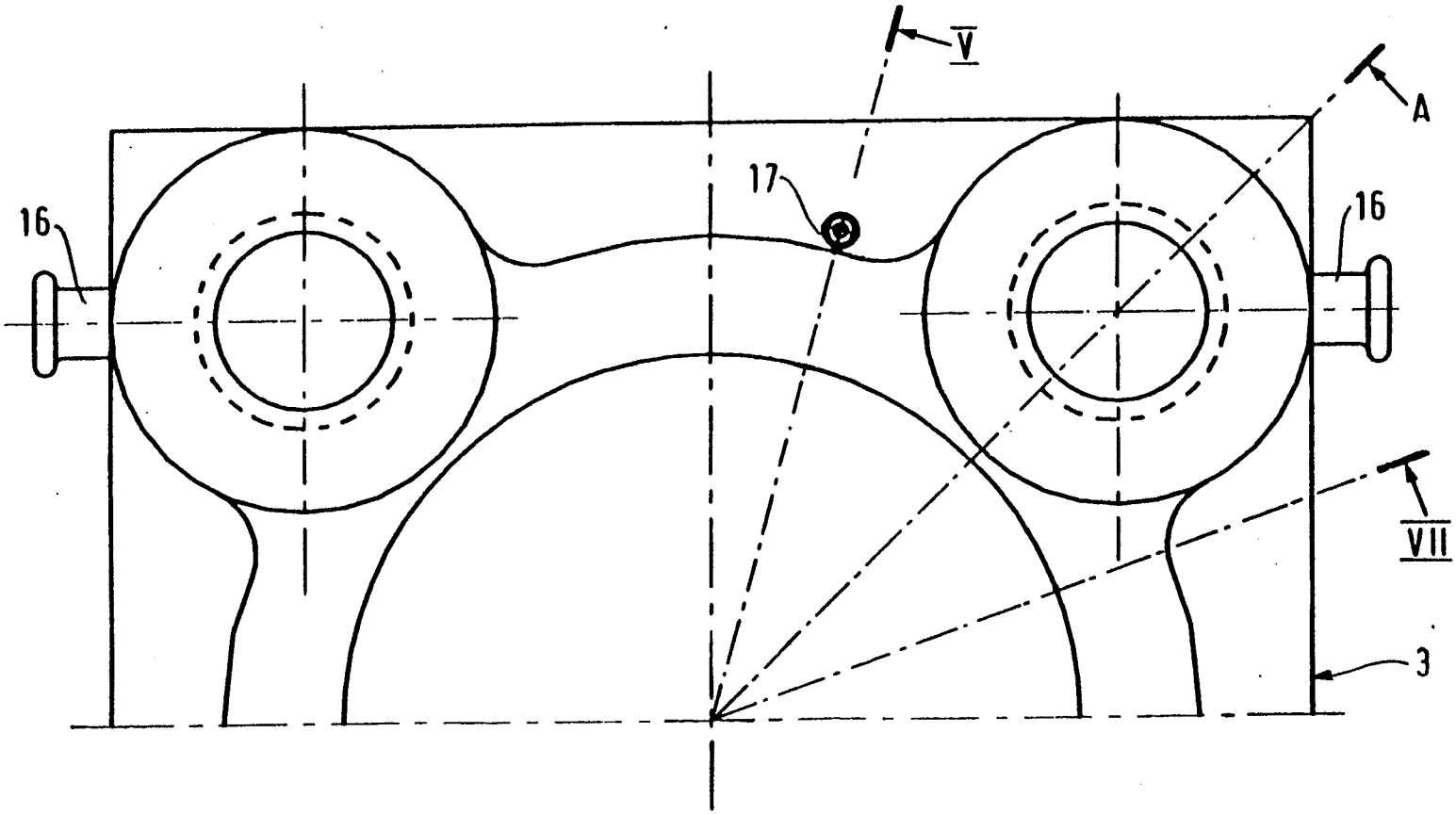
FIG. 6 is a plan view of half of the crosshead.

FIG. 6 is a plan half-view of the crosshead 3. The crosshead has four studs 16 enabling the press to be handled for transport purposes.

Figure 5:
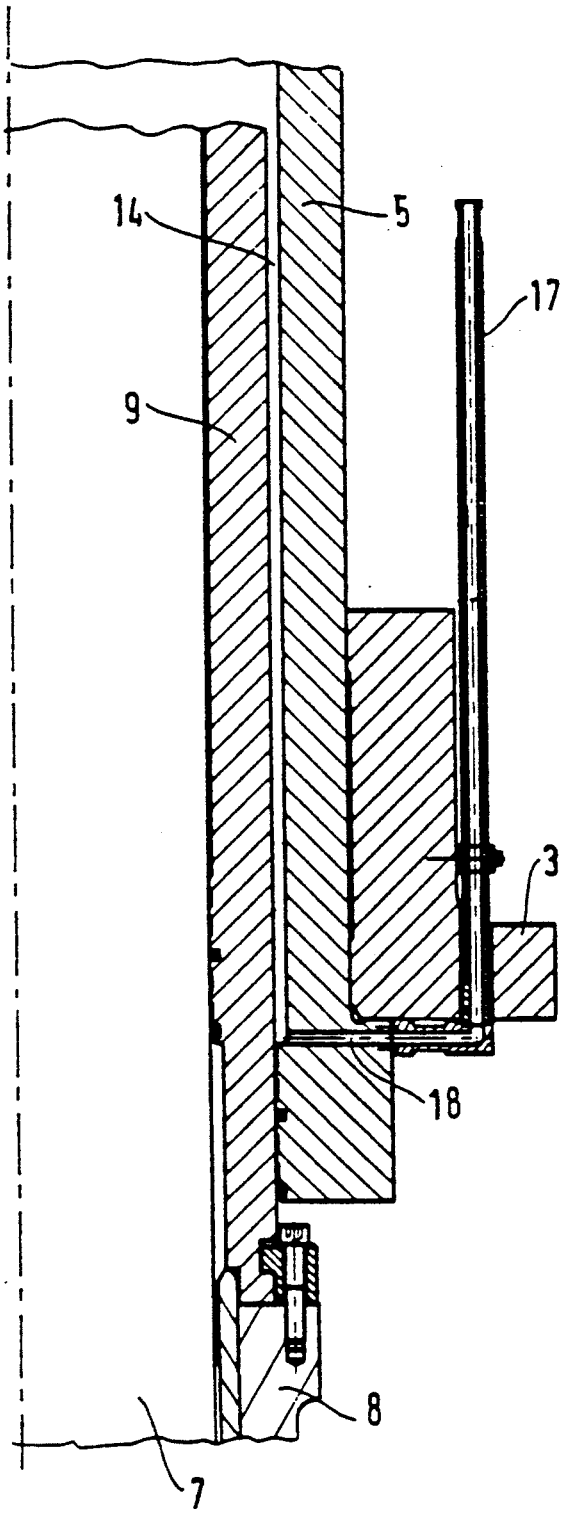
FIG. 5 is a detail (in section on V—V in FIG. 6) showing the feed ducts via which the annular chamber is fed with control fluid.

FIG. 5 is a detail showing the ducts 17, 18 via which the annular chamber 14 can be fed with control fluid. FIG. 5 shows the detail in a section on the plane V—V shown in FIG. 6.

The intermediate chamber 13 is fed by means of a sealed sliding device which comprises a tube 19 secured to the cylinder head 10 of the main cylinder 5. The tube 19 slides freely with some clearance inside a well 20 formed through the main piston 6 and into the ram rod 7 extending the main piston. A seal 21 provides sealing between the tube 19 and the well 20 at the top end of the well 20. Radial channels 22 connect the intermediate chamber 13 to the well 20, immediately below the piston 6. Naturally, the tube 19 is connected to a channel 23 provided in the cylinder head and open to the outside thereof so that the channel can be connected to a feed pipe (not shown).

The table 1 is provided with stops 24 for the assembly comprising the skirt 8 and the tubular piston 9. Furthermore, the skirt 8 includes guide blocks 25 for guiding it along the pillars 4.

A sealed metal bellows 26 connects the bottom end of the main cylinder 5 to the top end of the skirt 8.

The purpose of the bellows is to isolate the outside wall of the tubular piston 9 from the contaminated region situated under the crosshead 3. Level with the crosshead 3, a floor equipped with a seal (not shown) separates the contaminated bottom portion from the non-contaminated top portion. It is therefore necessary to prevent the outside wall of the tubular piston 9, which is lubricated by the control fluid, from bringing traces of contaminated fluid back into the fluid circuit when the skirt is being raised.

Figure 7:
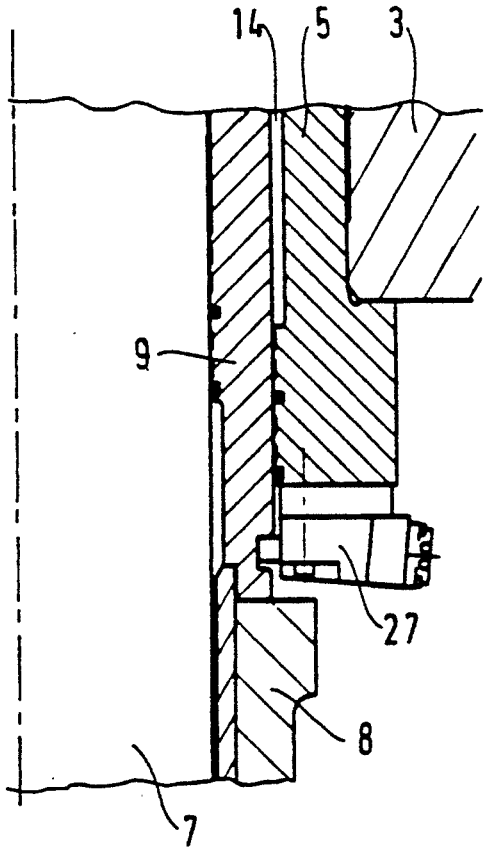
FIG. 7 is a detail (in section on VII—VII in FIG. 6) showing a safety lock for retaining the assembly formed by the skirt and the ram in the high position.

FIG. 7, which is a section on the plane referenced VII—VII in FIG. 6, shows a safety lock 27 for retaining both the skirt & tubular piston assembly 8-9 and the ram rod & main piston assembly 7-6 in the high position as shown in FIG. 1.

In the initial state, the press is in the position shown in FIG. 1. FIG. 1 shows a drum 28 placed on a pressing block 2 so that the drum can be compressed.

The lock 27 is unlocked, and the skirt is then lowered 8 by feeding oil into the intermediate chamber 13 via channels 23, 19, and 22. For example, the control pressure is 50 bars. The piston-ram assembly 6-7 remains in the high position because of the oil pressure on the bottom face of the piston 6.

Figure 2:
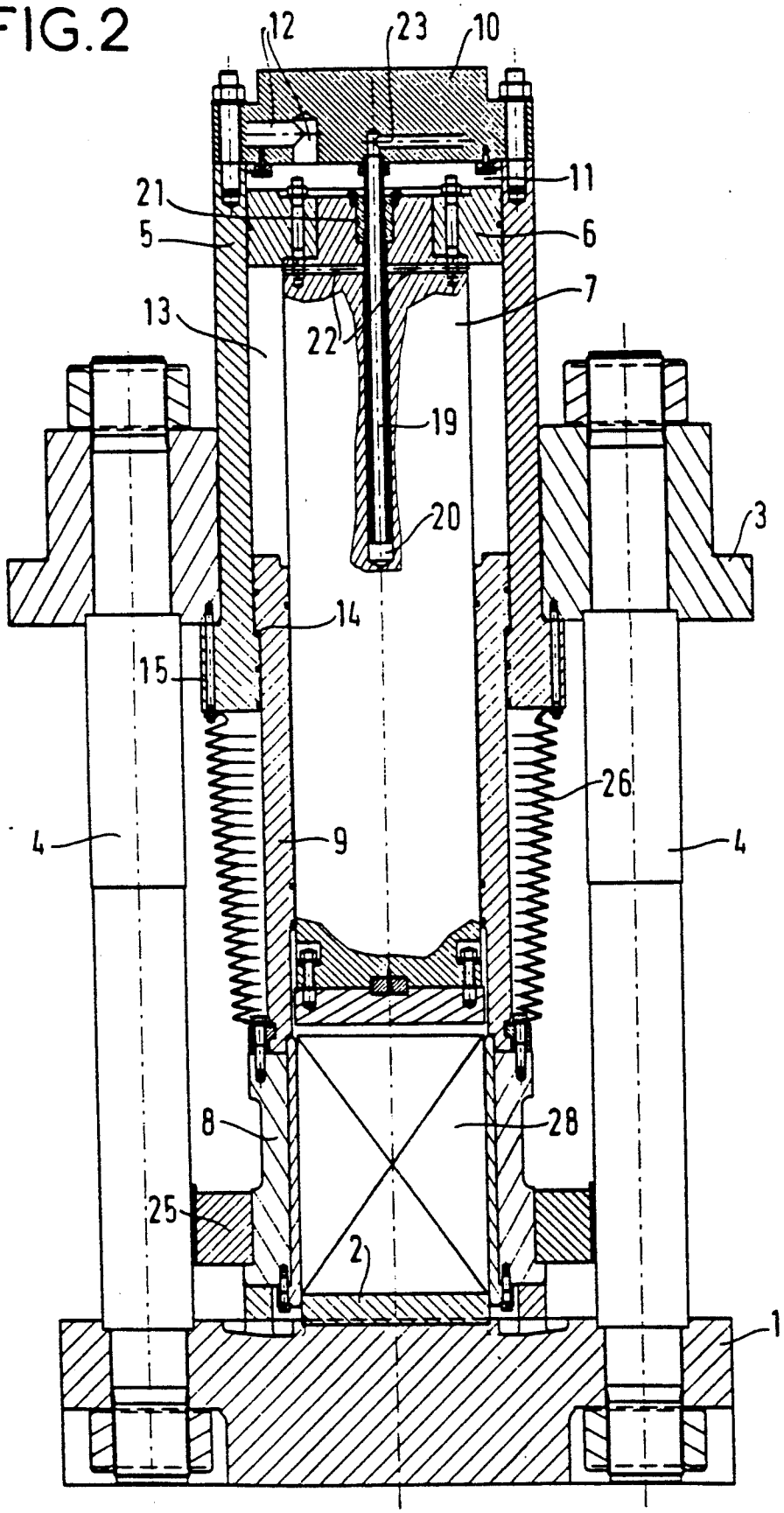
FIG. 2 shows the FIG. 1 press with the skirt being disposed in the low position and surrounding the drum to be compressed.

FIG. 2 shows the press in the position in which the skirt is lowered and surrounds the drum 2 to be compressed.

The output delivered by the pumps is then directed towards the main chamber 11 via channels 12, the intermediate chamber 13 being caused to communicate with the main chamber by means of a distributor valve. The pressure is thus applied to the piston 6 over a cross-sectional area equal to the area of the top surface of the main piston 6 minus the area corresponding to the cross-section of the intermediate chamber 13, i.e. equal to the cross-sectional area of the ram rod 7. The pressure applied is 50 bars, and it generates a precompacting force corresponding to 10% of the nominal force of the press.

Said pressure also generates the force required to maintain the skirt 8 pressed against the stops 24 for the entire duration of the precompacting and compacting operations.

Figure 3:
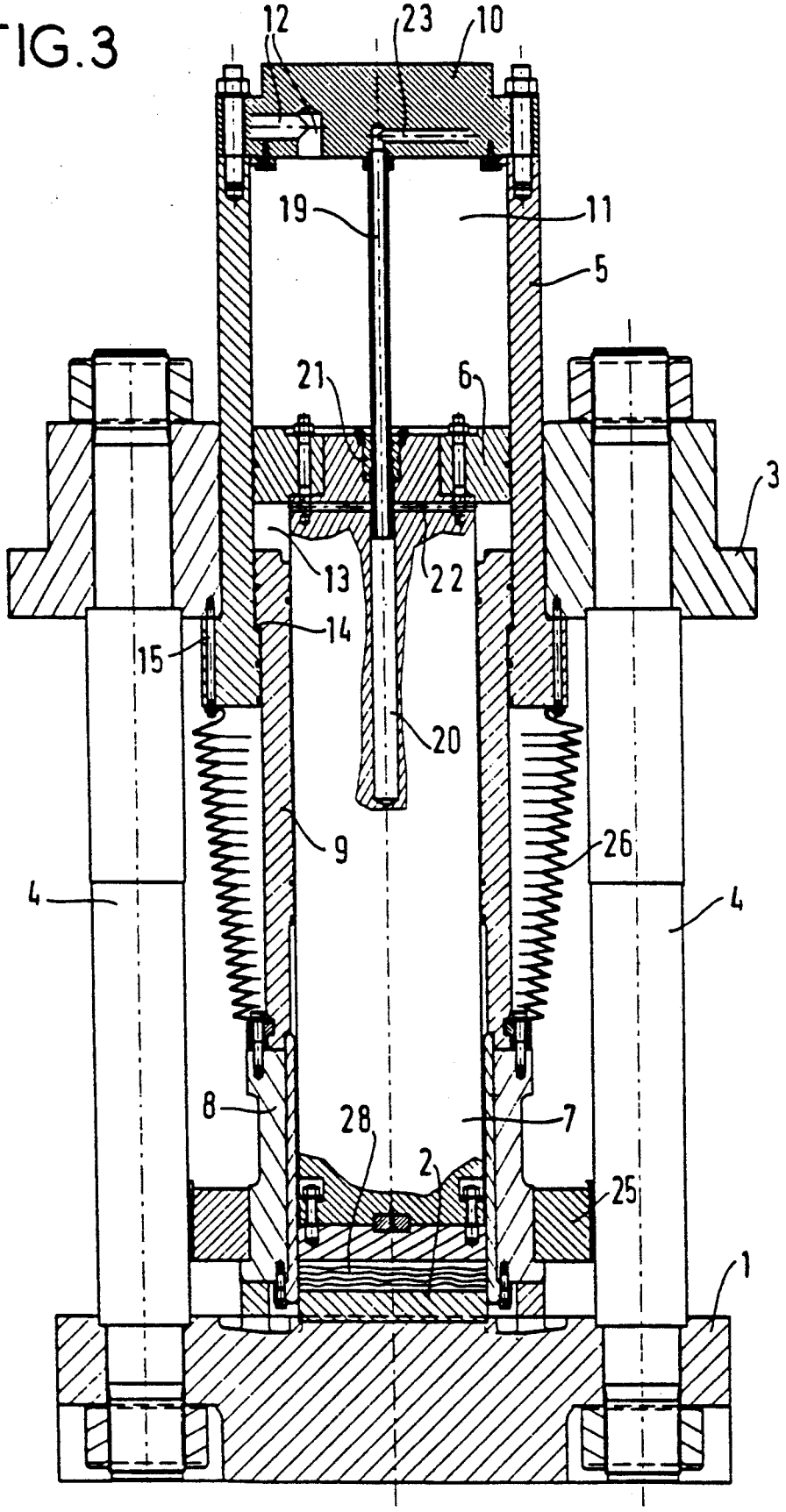
FIG. 3 shows the press during the final stage of compression, with both the skirt and the ram in the low position.

When this force is reached, the communication between the intermediate chamber 13 and the main chamber 11 is closed off, and the intermediate chamber is connected to the feed oil tank via a balancing valve, and a 315-bar high-pressure pump delivers into the main chamber 11 only. FIG. 3 slows the final stage of compression, with both skirt and ram rod in the low position. The drum 28 is reduced to a pancake.

The oil both in the main chamber and in the intermediate chamber is decompressed, and the pancake is then stripped by the skirt being raised again, by sending oil into the annular chamber 14 via the duct 17 (FIG. 5) while preventing oil from leaving the main chamber 11 by means of a distributor valve so that the main piston 6 is not raised simultaneously, the intermediate chamber 13 being caused to communicate with the oil tank.

Once the skirt is clear of the drum reduced to a pancake, the skirt continues to be raised while a delivery valve 29 (FIG. 1) of the main chamber 11 is opened so that the oil flows out into the oil tank. The tubular piston 9 meets the main piston 6 and drives said main piston 6 up with it as it continues on its upward stroke.

When the high position is reached, the pumps are stopped and the skirt and ram piston assembly are balanced in the high position by means of the oil in the annular chamber 14, which oil is stopped by means of a balancing valve rated at 50 bars. The safety lock 27 (FIG. 7) is put in place for safety reasons.

FIG. 4 shows the press in its transport state. Its overall height is reduced by sliding the main cylinder 5 downwards after the skirt and the ram rod pave been put in the low position, and the nuts of the bolts 15 have been unscrewed.

I claim:

1. A press for compressing drums of contaminated waste, said press comprising: a frame, said frame including a table and a crosshead connected to the table by means of vertical supports, and a compression assembly including a main cylinder secured to the crosshead, a main piston situated inside said main cylinder and delimiting a main chamber between said main piston and the cylinder head of said main cylinder, a ram rod mounted to and extending downwardly from said main piston, a skirt surrounding said drum when said drum is being compressed by the ram, a tubular piston extending upwardly from a top of said skirt, said tubular piston being slidably received in said main cylinder between said main cylinder and said ram rod, means defining an intermediate chamber between said tubular piston and the main piston, means defining an annular chamber between said tubular piston and a bottom end of the main cylinder, ducts opening to said main chamber and to said annular chamber, means for feeding said ducts with a control fluid, and said intermediate chamber including a sealed sliding device for controlling feed of said control fluid to said intermediate chamber.

2. A press according to claim 1, wherein said sealed sliding device comprises a tube secured to a cylinder head of the main cylinder and being slidably mounted inside a well extending through said main piston and into the ram rod, means defining a clearance between said tube and the side wall of the well, said sealing device being at the top of the well between the piston and the tube, and at least one radial channel within a top of said ram rod, immediately below the main piston, connecting said intermediate chamber to said well.

3. A press according to claim 2, wherein said main cylinder is removably secured to said main crosshead, whereby the overall height of the press can be reduced for transport purposes by sliding said main cylinder downwards, with said main piston disposed at the level of the crosshead.

4. A press according to claim 2, wherein a sealed bellows connects the bottom end of said main cylinder to a top of the skirt where the skirt is secured to said tubular piston.

5. A press according to claim 1, wherein said main cylinder is removably secured to said main crosshead, whereby the overall height of the press can be reduced for transport purposes by sliding said main cylinder downwards, with said main piston disposed at the level of the main crosshead.

6. A press according to claim 1, wherein a sealed bellows connects the bottom end of said main cylinder to a top of the skirt where the skirt is secured to said tubular piston.

* * * * *